US008292597B2

(12) United States Patent
Rago

(10) Patent No.: US 8,292,597 B2
(45) Date of Patent: Oct. 23, 2012

(54) HIGH-SPEED GEAR PUMP

(75) Inventor: Giuseppe Rago, Mississauga (CA)

(73) Assignee: Pratt & Whitney Canada Corp., Longueuil (CA)

( * ) Notice: Subject to any disclaimer, the term of this patent is extended or adjusted under 35 U.S.C. 154(b) by 877 days.

(21) Appl. No.: 12/252,641

(22) Filed: Oct. 16, 2008

(65) Prior Publication Data

US 2010/0098572 A1 Apr. 22, 2010

(51) Int. Cl.
*F04B 25/00* (2006.01)
*F04B 3/00* (2006.01)
*F04B 5/00* (2006.01)

(52) U.S. Cl. ..... 417/247; 417/246; 417/307; 418/196; 418/201.3; 418/205; 418/206.1; 418/206.2

(58) Field of Classification Search ..... 417/307, 417/246, 247; 418/206.1, 196, 201.3, 205, 418/206.2
See application file for complete search history.

(56) References Cited

U.S. PATENT DOCUMENTS 1,734,779 A * 11/1929 Randolph ..... 418/9
2,255,851 A 9/1941 Lundin
2,354,992 A * 8/1944 Gottlieb ..... 418/196
2,849,863 A 9/1958 Dubrovin
3,120,190 A * 2/1964 Schmitter et al. ..... 418/144
3,168,043 A 2/1965 Wiggermann
3,179,382 A * 4/1965 Knedlik ..... 366/272
3,179,383 A * 4/1965 Knedlik ..... 366/272
3,427,985 A * 2/1969 Difford ..... 418/126
3,447,422 A * 6/1969 Bidlack et al. ..... 418/196
3,481,532 A * 12/1969 Fraser ..... 418/9
3,597,131 A * 8/1971 Schofield et al. ..... 418/126
3,627,455 A 12/1971 Nasvytis
3,873,252 A * 3/1975 Motomura et al. ..... 418/126
3,951,575 A * 4/1976 Motomura et al. ..... 417/283
4,032,391 A * 6/1977 Moked et al. ..... 159/47.1
4,044,562 A * 8/1977 England ..... 60/721
4,204,811 A * 5/1980 Carter et al. ..... 417/288
4,475,870 A 10/1984 Eickmann
4,531,494 A 7/1985 Bailey et al.
4,597,717 A 7/1986 Mohr
4,815,954 A * 3/1989 Underwood ..... 418/196
4,824,331 A 4/1989 Bowden
4,850,813 A * 7/1989 Fisher ..... 417/288
4,859,158 A * 8/1989 Weinbrecht ..... 418/9
4,872,536 A * 10/1989 Yue ..... 188/290
4,932,504 A * 6/1990 Zheng ..... 188/290
5,299,920 A 4/1994 Stearns
5,609,474 A 3/1997 Ohno
5,738,501 A 4/1998 Eisenmann
5,842,449 A 12/1998 Eisenmann
(Continued)

*Primary Examiner* — Nimeshkumar Patel
*Assistant Examiner* — Thomas A Hollweg
(74) *Attorney, Agent, or Firm* — Norton Rose Canada LLP

(57) ABSTRACT

A gear pump comprises a casing having an inlet, an interior, and an outlet. An inlet gear is positioned at the inlet and pressurizes fluid received at the inlet. A drive gear is positioned at the outlet of the casing, the drive gear receiving fluid pressurized by the inlet gear to output pressurized fluid at the outlet. A speed-reduction gear is meshed to the drive gear and connected to the at least one inlet gear, the speed-reduction gear having a greater number of teeth than the drive gear to reduce a rotational speed from the drive gear to the inlet gear, such that the inlet gear has a lower speed that the drive gear. An input shaft is coupled to the drive gear and receives a rotational input to actuate the drive gear.

20 Claims, 2 Drawing Sheets

U.S. PATENT DOCUMENTS

| | | | | |
|---|---|---|---|---|
| 6,126,420 | A | 10/2000 | Eisenmann | |
| 6,158,976 | A | 12/2000 | Natsunari et al. | |
| 6,588,207 | B1 * | 7/2003 | Pouliot | 60/487 |
| 6,688,498 | B1 * | 2/2004 | McGuffey | 222/333 |
| 7,335,005 | B2 * | 2/2008 | Cottais | 418/196 |
| 7,841,082 | B2 * | 11/2010 | Lurtz | 29/888.023 |
| 2006/0067849 | A1 * | 3/2006 | Kimura et al. | 418/61.3 |
| 2006/0140810 | A1 * | 6/2006 | Kameya et al. | 418/61.3 |
| 2007/0266818 | A1 * | 11/2007 | Weston | 74/606 A |
| 2008/0056912 | A1 | 3/2008 | Pizzichil et al. | |

* cited by examiner

HIGH-SPEED GEAR PUMP

TECHNICAL FIELD

The technical field relates to positive displacement pumps, and more particularly to gear pumps used with high-speed power sources.

BACKGROUND

The speed of gear pumps is limited by cavitation. By increasing an inlet pressure of pumps, pumps may operate greater speeds without causing cavitation. As the speed of gear pumps is limited by the inlet pressure, gear pumps are commonly used with cumbersome boost pumps, pressurized tanks and the like to feed pressurized fluid to the inlet. Such techniques, however, present problems were space or weight may be an issue, and may also present unwanted costs and complexity. There is therefore a need for improvement.

SUMMARY

According to one aspect, there is provided a gear pump comprising a casing having an inlet adapted to receive a fluid, an interior to receive gears to pressurize the fluid, and an outlet to output pressurized fluid; at least one inlet gear positioned at the inlet and adapted to pressurize fluid received at the inlet; a drive gear positioned at the outlet of the casing, the drive gear adapted to received fluid pressurized by the at least one inlet gear to output pressurized fluid at the outlet; a speed-reduction gear meshed to the drive gear and connected to the at least one inlet gear, the speed-reduction gear having a greater number of teeth than the drive gear to reduce a rotational speed from the drive gear to the at least one inlet gear, such that the at least one inlet gear has a lower speed that the drive gear; and an input shaft coupled to the drive gear and adapted to receive a rotational input to actuate the drive gear.

In accordance with another aspect, there is provided a method for operating a gear pump comprising: actuating a drive gear with a rotational input; driving an inlet gear through a gear assembly meshed with the drive gear such that inlet gear rotates slower than the drive gear; inletting a fluid supply to the inlet gear whereby the inlet gear pressurizes the fluid supply, and feeds the fluid supply to the drive gear; and outletting the fluid supply further pressurized by the drive gear.

Further details of these and other aspects of the improvements presented herein will be apparent from the detailed description and appended figures.

DETAILED DESCRIPTION

Figure 1:
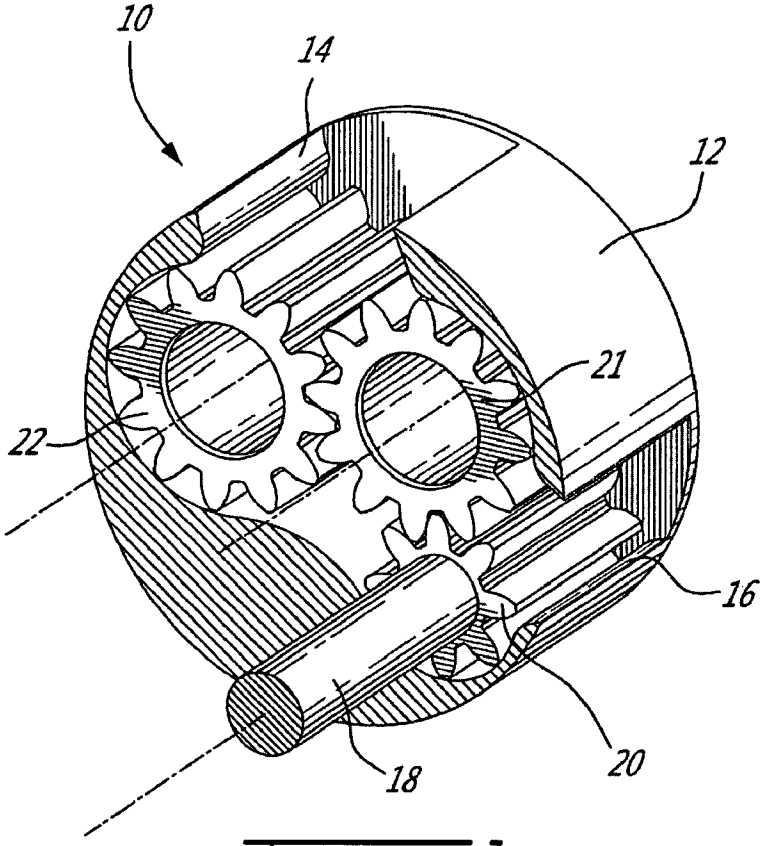
FIG. 1 is an isometric view, partly sectioned, of a high-speed gear pump in accordance with an embodiment of the present application.

Referring to FIG. 1, a high-speed gear pump is shown at 10, for pumping fluids such as oil and fuel. The gear pump 10 has a casing 12 accommodating a gear assembly. To illustrate an interior of the gear pump 10, a portion of the casing 12 is removed from FIGS. 1 and 2. The casing 12 has a fluid inlet 14 and a fluid outlet 16.

The gear pump 10 has an input shaft 18 connected to a power source (not shown), such as a high-speed electric motor or the like. A drive gear 20 is directly coupled to the input shaft 18. The drive gear 20 is positioned adjacent to the outlet 16 in the casing 12.

A first driven gear 21 and a second driven gear 22 are positioned adjacent to the inlet 14 in the casing 12. The first driven gear 21 is meshed with the drive gear 20, and is thereby driven by the input shaft 18. The second driven gear 22 is meshed with the first driven gear 21, whereby the first driven gear 21 transmits actuation from the drive gear 20 to the second driven gear 22.

Figure 2:
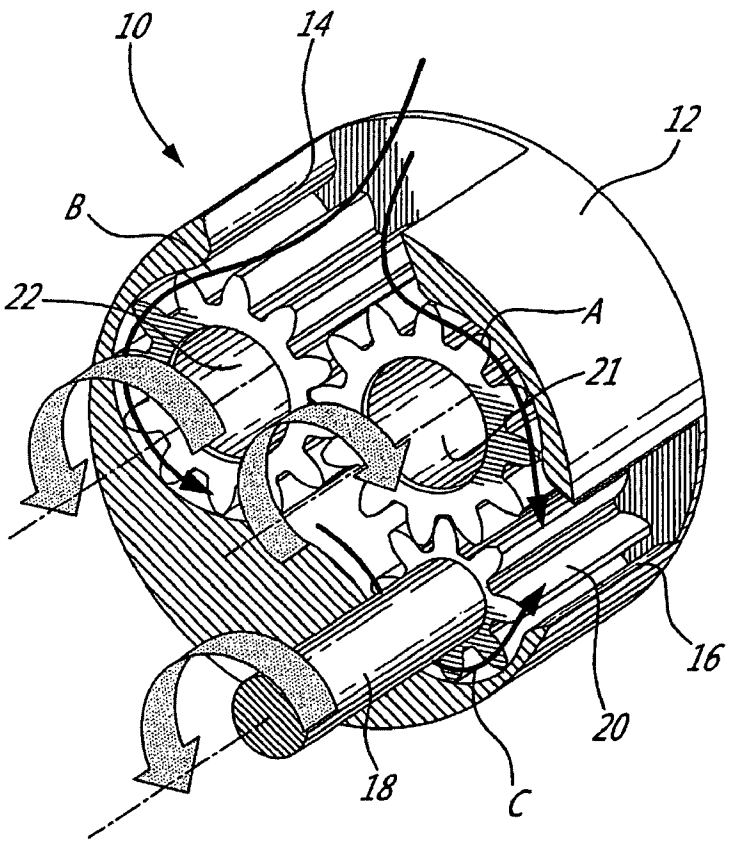
FIG. 2 is an isometric sectioned view of the high-speed gear pump of FIG. 1, with gear rotational directions and fluid flow paths illustrated.

The drive gear 20 has a smaller number of teeth than the first driven gear 21 and the second driven gear 22. The driven gear 21 and 22 may or may not have the same number of teeth. In FIGS. 1 and 2, the drive gear 20 has eight teeth, while the driven gears 21 and 22 both have twelve teeth. Therefore, the gear ratio of the gear assembly results in a smaller rotational speed for the driven gears 21 and 22 than for the drive gear 20, as the driven gear 21 acts as a speed-reduction gear in the gear assembly.

Referring to FIG. 2, a direction of rotation of the gears 20, 21 and 22 is depicted, as are paths of the fluid flow within the casing 12 from the inlet 14 to the outlet 16. As illustrated by path A, a first portion of the fluid received by the inlet 14 is pressurized by passing between the first driven gear 21 and an interior of the casing 12, to reach the outlet 16. As illustrated by path B, a second portion of the fluid received by the inlet 14 is pressurized by passing between the second driven gear 22 and an interior of the casing 12. The pressurized fluid illustrated by path B is then at least partially pressurized by passing between the drive gear 20 and the casing 12, as illustrated by path C. The pressure of the fluid at the outlet 16 is therefore a mix of the pressures of the fluids coming from paths A and C.

As the pressure of the fluid is higher at the exit of path B than at the inlet 14, the drive gear 20 may rotate faster than if it were at the inlet 14, without causing cavitation. The arrangement by which the smaller and faster gear is at the outlet 16 while the larger and slower gear is at the inlet 14 allows the use of a rotational input of higher speed without causing cavitation.

Moreover, in order to increase the pressure at the inlet to gear 20, the leakage of fluid to path C may be controlled, to return some pressurized fluid to the outlet to gear 22. The leakage is controlled by a direct path from outlet 16 by a cored line or by increasing the clearance between the gear 20 and the housing. By this leakage, the speed of the drive gear 20 may be increased.

The second driven gear 22 may be the only inlet gear, namely the only gear receiving fluid from the inlet 14. Other configurations are considered as well.

Figure 3:
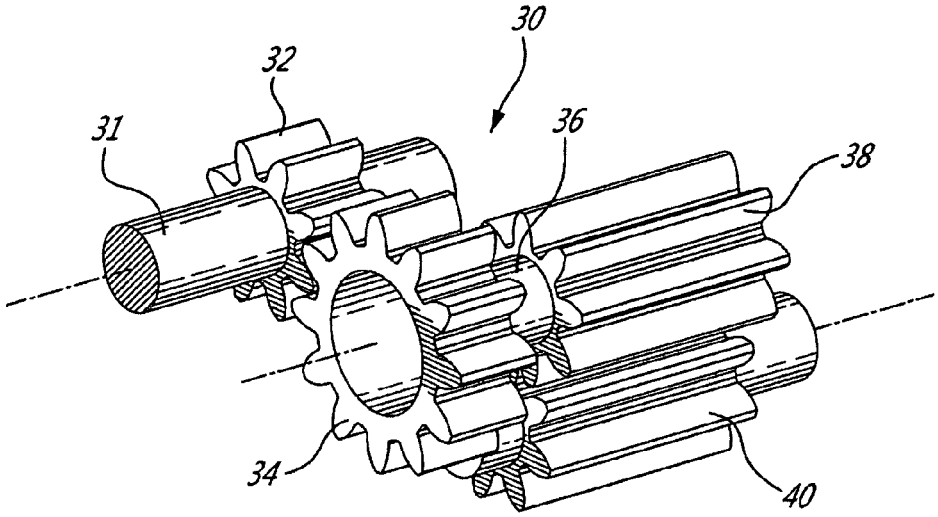
FIG. 3 is an isometric view of a gear assembly of a two-stage high-speed gear pump in accordance with another embodiment of the present application.

Referring to FIG. 3, a two-stage high-speed gear pump is illustrated at 30. For clarity purposes, the gear pump 30 is shown without a casing. The gear-pump 30 has an input shaft 31 connected to a power source, such as a high-speed electric motor or the like. Drive gear 32 is coupled to the input shaft 31. Outlet-stage driven gear 34 is meshed with the drive gear 32, whereby rotational actuation of input shaft 31 is transmitted to the driven gear 34 through the drive gear 32. The drive gear 32 has a smaller number of teeth than the driven gear 34, and therefore rotates faster than the driven gear 34. The driven gear 34 acts as a speed-reduction gear in the gear assembly. In FIG. 3, as an example, the drive gear 32 has eight teeth, whereas the driven gear 34 has twelve teeth.

The outlet-stage driven gear 34 has a coupling shaft 36 by which it is directly coupled to an inlet-stage first gear 38. The inlet-stage first gear 38 therefore rotates with the outlet-stage driven gear 34.

The inlet-stage first gear 38 is meshed with an inlet-stage second gear 40. In FIG. 3, the first gear 38, and the second gear 40 of the inlet stage have the same number of teeth, namely eight teeth. The first gear 38 and the second gear 40 may have a different number of teeth.

Figure 4:
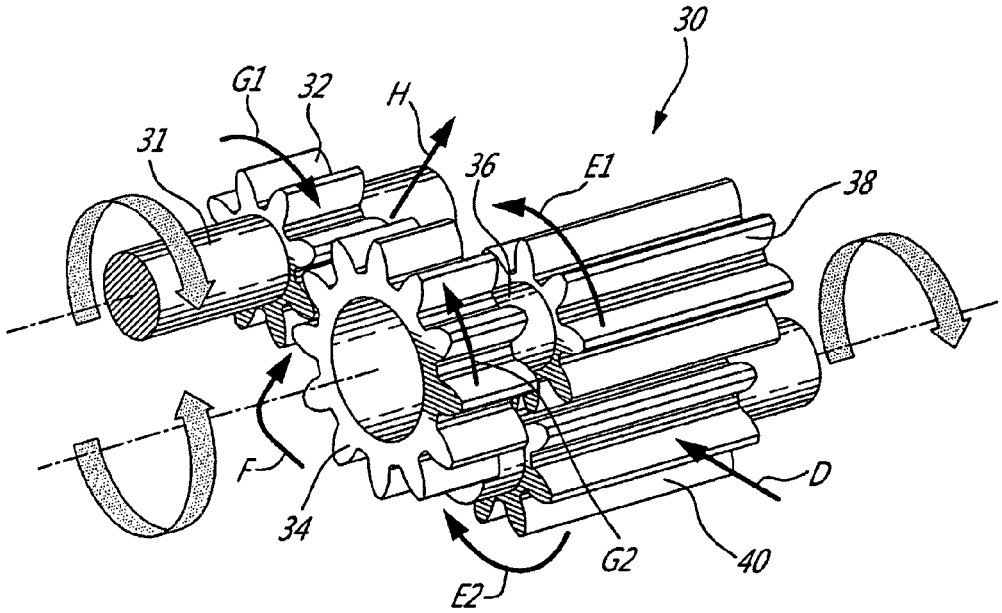
FIG. 4 is an isometric view of the gear assembly of the two-stage high-speed gear pump of FIG. 3, with gear rotational directions and a fluid flow illustrated.

Referring to FIG. 4, a direction of rotation of the gears 32, 34, 38 and 40 is depicted, as are paths of fluid flow from the inlet to the outlet of the gear pump 30.

The inlet stage of the gear pump 30 comprises the first gear 38 and the second gear 40. Accordingly, inlet fluid D is pressurized by passing through paths E1 or E2, respectively between the tips of the first gear 38 and an interior of the casing (not shown) and between the tips of the second gear 40 and an interior of the casing (not shown). The pressurized fluid from paths E1 and E2 them reaches the second stage, as illustrated by path F.

The outlet stage of the gear pump 30 comprises the drive gear 32 and the driven gear 34. The pressurized fluid from the path F is partly directly about the drive gear 32 in path G1 and about the driven gear 34 in path G2, to respectively be pressurized between the drive gear 32 and the casing (not shown), and the driven gear 34 and the casing (not shown). The outlet fluid H is therefore a mix of the pressurized fluid from paths G1 and G2.

In the gear pump 30, the gear with the higher speed is the drive gear 32. As it is at the outlet of the gear pump 30, the drive gear 32 is fed pressurized fluid from the inlet stage, whereby it may rotate at higher speed without causing cavitation. By the gear reduction resulting from the gear arrangement of the gear pump 30, the first and second gears 38 and 40 at the inlet rotate at lower speeds as a function of the inlet pressure.

Leakage may be controlled across the inlet stage and outlet stage. By limiting the leakage, the inlet pressure is increased, thereby enabling the gears of the gear pump 30 to rotate faster.

As is shown in FIG. 3, the second gear 40 has a shaft. Other pump stages may be stacked to the two stages of the gear pump 30, in a multi-stage configuration. The first gear 38 may be the only inlet gear, namely the only gear receiving fluid from the inlet, or the only gear in the first stage. Other configurations are considered as well.

In operating the gear pump 10 (FIGS. 1-2) and the gear pump 30 (FIGS. 3-4), the tip velocity of the gears 21/22 and gears 38/40, respectively, may be controlled as a function of the measurement of the fluid inlet pressure, so as not to cause failure due to cavitation. By maintaining a higher inlet pressure, the gears may rotate faster.

The gear pump 10 (FIGS. 1-2) and the gear pump 30 (FIGS. 3-4) may be used as fuel pumps. In such a use, the gear pumps 10 and 30 have a compact and simple design. Moreover, the gear pumps 10 and 30 are self-lubricating and may therefore be used in environments where auxiliary lubrication systems are not available. In turbine engine applications, the drive gears may be smaller when receiving a rotational input from the accessory gear box, thereby resulting in a compact gear pump.

Still other modifications will be apparent to those skilled in the art, in light of a review of this disclosure, and such modifications are intended to fall within the scope of the appended claims.

What is claimed is:

1. A gear pump comprising:

a casing having at least one inlet adapted to receive a fluid, an interior to receive gears to pressurize the fluid, and an outlet to output pressurized fluid;

at least one inlet gear positioned at each of the at least one inlet and adapted to pressurize fluid received at an associated one of the at least one inlet;

a drive gear positioned at the outlet of the casing, the drive gear adapted to receive fluid pressurized by the at least one inlet gear and to output pressurized fluid at the outlet;

a speed-reduction gear meshed to the drive gear and connected to the at least one inlet gear, the speed-reduction gear having a greater number of teeth than the drive gear to reduce a rotational speed from the drive gear to the at least one inlet gear, such that the at least one inlet gear has a lower speed that the drive gear; and an input shaft coupled to the drive gear and adapted to receive a rotational input to actuate the drive gear, wherein at each and every one of said at least one inlet, the associated at least one inlet gear is driven at a lower speed than the drive gear via said speed-reduction gear.

2. The gear pump according to claim 1, wherein the speed-reduction gear is meshed with the inlet gear.

3. The gear pump according to claim 2, wherein the speed-reduction gear is placed at the inlet concurrently with the inlet gear, the speed-reduction gear being adapted to pressurize fluid received at the inlet, to output pressurized fluid to the outlet.

4. The gear pump according to claim 2, wherein the speed-reduction gear has a same number of teeth as the inlet gear.

5. The gear pump according to claim 4, wherein the drive gear has eight teeth, and the inlet gear and speed-reduction gear both have twelve teeth.

6. The gear pump according to claim 1, further comprising means adapted to control a proportion of fluid supplied to the drive gear versus a proportion of fluid returned to the inlet after being pressurized by the inlet gear.

7. The gear pump according to claim 1, further comprising at least a first stage and a second stage, the first stage comprising the inlet and the at least one inlet gear, the second stage comprising the drive gear, the speed-reduction gear and the outlet, the first stage and the second stage being in fluid communication to be adapted to supply fluid from the first stage to the second stage.

8. The gear pump according to claim 7, wherein the inlet gear and the speed-reduction gear are directly coupled by a common shaft.

9. The gear pump according to claim 8, wherein the first stage has two of the inlet gear, with a first inlet gear being directly coupled to the speed-reduction gear by the common shaft, and a second inlet gear being meshed with the first inlet gear.

10. The gear pump according to claim 9, wherein the second inlet gear has a shaft adapted to be coupled to another stage of the gear pump.

11. The gear pump according to claim 9, wherein the first inlet gear and the second inlet gear have a same number of teeth.

12. The gear pump according to claim 11, wherein the first inlet gear, the second inlet gear and the drive gear have eight teeth, and the speed-reduction gear has twelve teeth.

13. The gear pump according to claim 7, further comprising means adapted to control a proportion of fluid supplied from the first stage to the second stage versus a proportion of fluid returned to the inlet after being pressurized by the inlet gear.

14. A method for operating a gear pump comprising:

positioning a drive gear at a fluid outlet of the pump away from any fluid inlet thereof;

actuating the drive gear with a rotational input;

driving an inlet gear through a gear assembly meshed with the drive gear such that inlet gear rotates slower than the drive gear;

inletting a fluid supply to the inlet gear whereby the inlet gear pressurizes the fluid supply, and feeds the fluid supply to the drive gear; and outletting the fluid supply further pressurized by the drive gear.

15. The method according to claim 14, wherein inletting a fluid supply comprises inletting a portion of the fluid supply to a speed-reduction gear of the gear assembly, and outletting the portion of the fluid supply pressurized by the speed-reduction gear.

16. The method according to claim 14, further comprising controlling a proportion of fluid supplied to the drive gear versus a proportion of fluid returned to the inletting after being pressurized by the inlet gear.

17. The method according to claim 14, further comprising measuring a pressure of the fluid supply at the inlet, and controlling the rotational input as a function of the pressure.

18. The method according to claim 14, wherein inletting a fluid supply comprises inletting the fluid supply in a first stage of a gear pump, outletting the fluid supply comprises outletting the fluid supply in a second stage of the gear pump, and feeding the fluid supply to the drive gear comprises feeding the fluid supply from the first stage to the second stage of the gear pump.

19. The method according to claim 18, further comprising controlling a proportion of the fluid supplied to the second stage versus a proportion of fluid returned to the inletting after being pressurized by the inlet gear.

20. The method according to claim 18, wherein inletting a fluid supply comprises inletting the fluid supply in a first stage of a gear pump as received from at least another stage of the gear pump.

* * * * *